US005373353A

United States Patent [19]

Fukasawa

[11] Patent Number: 5,373,353

[45] Date of Patent: Dec. 13, 1994

[54] DEVELOPING DEVICE FOR AN IMAGE FORMING APPARATUS

[75] Inventor: Hisashi Fukasawa, Tokyo, Japan

[73] Assignee: NEC Corporation, Tokyo, Japan

[21] Appl. No.: 17,242

[22] Filed: Feb. 12, 1993

[30] Foreign Application Priority Data

Feb. 13, 1992 [JP] Japan ..... 4-026312

[51] Int. Cl.[5] ..... G03G 15/06

[52] U.S. Cl. ..... 355/259; 118/653

[58] Field of Search ..... 355/245, 259, 246, 279, 355/260, 253; 118/653, 652

[56] References Cited

U.S. PATENT DOCUMENTS 4,073,583 2/1978 Teumer et al. ..... 355/279
4,616,918 10/1986 Kohyama et al. ..... 355/259
5,132,734 7/1992 Momiyama et al. ..... 355/260 X
5,170,213 12/1992 Yamaguchi et al. ..... 355/245 X
5,177,323 1/1993 Kohyama ..... 118/653
5,239,344 8/1993 Enoki et al. ..... 355/259
5,245,391 9/1993 Suzuki et al. ..... 118/653 X

*Primary Examiner*—A. T. Grimley
*Assistant Examiner*—Shuk Y. Lee
*Attorney, Agent, or Firm*—Sughrue, Mion, Zinn, Macpeak & Seas

[57] ABSTRACT

A developing device for an electrophotographic image forming apparatus has a toner layer regulating member which presses a toner carrier with a bent portion thereof and extends in a direction generally opposite to an intended direction of rotation of the toner carrier. The toner carrier is made of silicone rubber, urethane rubber or similar elastic material while the toner layer regulating member is implemented as a spring member made of metal.

3 Claims, 4 Drawing Sheets

DEVELOPING DEVICE FOR AN IMAGE FORMING APPARATUS

BACKGROUND OF THE INVENTION

The present invention relates to a developing device for a laser printer, facsimile transceiver, copier or similar electrophotographic image forming apparatus. More particularly, the present invention is concerned with a toner layer regulating member incorporated in the developing device for causing a toner to form a thin layer, i.e., substantially a single layer on a toner carrier so as to charge it uniformly and stably.

One of conventional developing devices for the above application includes a toner carrier in the form of a roller or a sleeve, a toner supply roller, an agitator, and a toner layer regulating member. The toner carrier deposits a charged developer or toner on a photoconductive element or similar image carrier on which a latent image is electrostatically formed. The toner supply roller supplies the toner to the surface of the toner carrier. The agitator conveys the toner to the toner supply roller while agitating it. The toner layer regulating member causes the toner to form a layer on the toner carrier while charging it This kind of developing, device is disclosed in, for example, U.S. Pat. No. 5,142,330 (Hirano et al.).

It has been customary to make the toner carrier of aluminum, stainless steel or similar rigid material and to make the toner layer regulating member of silicone rubber, urethane rubber or similar elastic material. The problem with such a combination is that even though the regulating member regulates the toner on the toner carrier, the toner deposits thickly in more than one layer(s) or thinly in less than one layer. Such a toner layer cannot be charged uniformly or stably, failing to produce an attractive image. Specifically, it often occurs that much of the toner is charged to a polarity opposite to the expected one and deposited on the background of a latent image formed on the image carrier to thereby contaminate it.

SUMMARY OF THE INVENTION

It is, therefore, an object of the present invention to provide a developing device for an image forming apparatus which regulates a toner deposited on a toner carrier into substantially a single layer by a toner layer regulating member so as to charge the toner uniformly and stably enough to insure high image quality.

A developing device incorporated in an image forming apparatus for developing a latent image representative of image data and electrostatically formed on an image carrier by a toner to produce a corresponding toner image of the present invention comprises a toner carrier made of an elastic material for supplying the toner to the image carrier, and a toner layer regulating member constituted by a spring member made of metal for regulating the thickness of the toner deposited in a layer on the toner carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
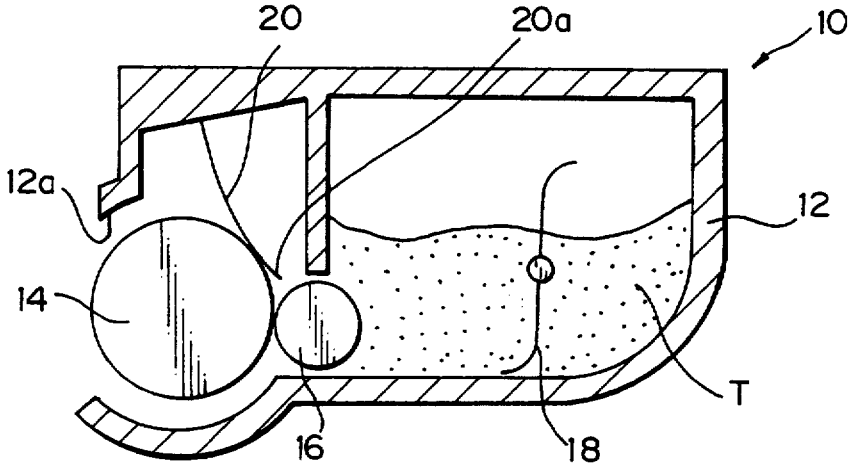
Fig. 1 PRIOR ART
FIG. 1 is a section showing a conventional developing device.

To better understand the present invention, a brief reference will be made to a conventional developing device for an image forming apparatus, shown in FIG. 1. As shown, the developing device, generally 10, has a casing 12 storing a developer in the form of a toner T. The casing 12 is formed with an opening 12*a*. A toner carrier 14 is implemented as a developing roller or a developing sleeve and located to face a photoconductive element or similar image carrier, not shown, via the opening 12*a* of the casing 12. A toner supply roller 16 supplies the toner T to the surface of the toner carrier 14. An agitator 18 is disposed in the casing 12 and rotatable for transporting the toner T to the toner supply roller 16 while agitating it. A toner layer regulating member 20 regulates the toner T on the toner carrier 14 into a layer of predetermined thickness while charging it. The toner layer regulating member 20 is constituted by a blade and made of silicone rubber, urethane rubber or similar elastic material. Since the free edge 20*a* of the blade 20 does not directly contact the toner carrier 14, it is not treated beforehand. The toner carrier 14 is made of aluminum, stainless steel or similar rigid material.

To cause the device 10 to constantly form an attractive image, it is necessary that the toner T be charged uniformly and stably at all times before supplied to the toner carrier 14. The blade 20, therefore, has to regulate the toner T on the toner carrier 14 to form a thin toner layer, i.e., substantially a single toner layer. However, in the conventional device 10 using the elastic blade 20 and rigid toner carrier 14 as stated above, the toner T forms two or more layers or less than one layer and, therefore, cannot be charged uniformly or stably. This increases, for example, the ratio of the toner T charged to a polarity opposite to expected one and thereby causes the toner T to deposit on the background of the photoconductive element.

Figure 2:
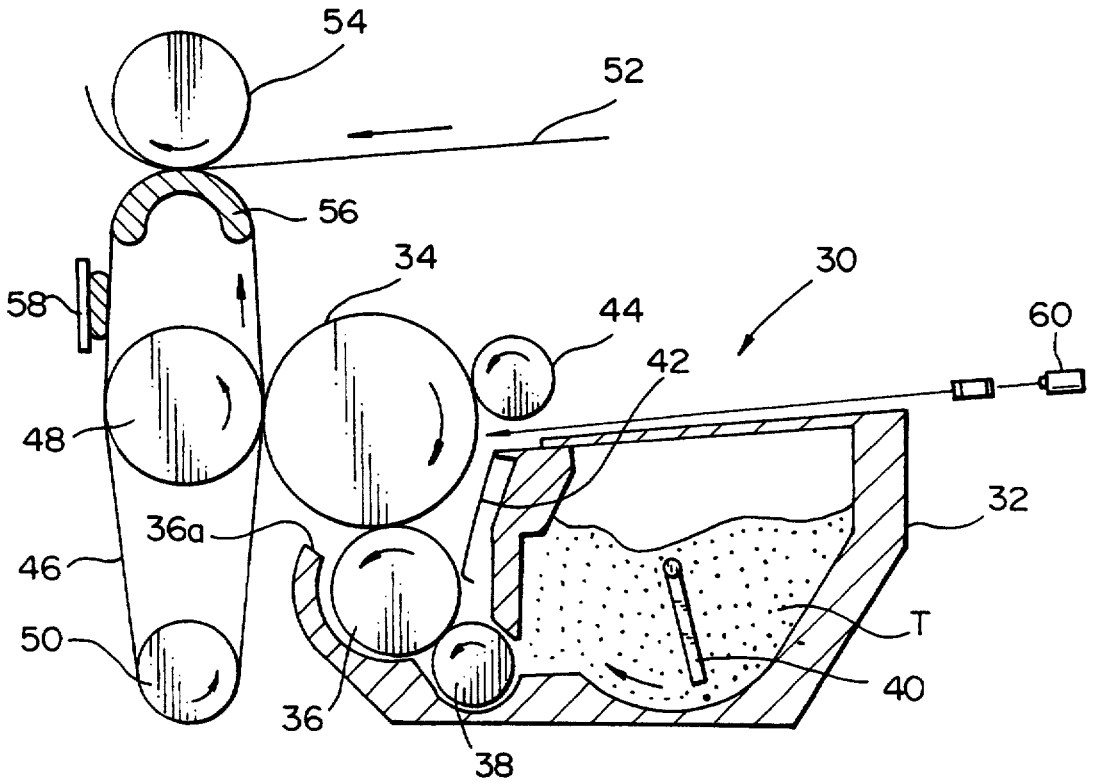
FIG. 2 is a section showing a developing device embodying the present invention.

Referring to FIG. 2, an image forming apparatus to which a developing device embodying the present invention is applied is shown and implemented as an electrophotographic copier by way of example. As shown, the developing device, generally 30, has a casing 32 storing a toner T and formed with an opening 30*a*. A toner carrier 36 is constituted by a developing, roller or a developing sleeve and located to face an image carrier 34 via the opening 32*a* of the casing 32. In the illustrative embodiment, the image carrier 34 is implemented by a photoconductive drum made of an organic photoconductor or selenium. A toner supply roller 38 supplies the toner T to the surface of the toner carrier 36. An agitator 40 is disposed in the casing 32 and rotatable in a direction indicated by an arrow in the figure for conveying the toner T to the toner supply roller 38 while agitating it. A blade or toner layer regulating member 42 regulates the toner T fed from the toner supply roller 38 to the toner carrier 36 to form a toner layer of predetermined thickness while charging it. A charge roller 44 is urged against the drum 34 for uniformly charging it. An transfer belt 46 is held in contact with the drum 34 and movable in a direction indicated by an arrow. The belt 46 has a particular resistance. A toner image formed on the drum 34 by the developing device 30 is transferred to the belt 46. A transfer roller 48 urges the belt 46 against the drum 36 for transferring the toner image from the drum 34 to the belt 46. A drive roller 50 moves the belt 46 in the above-mentioned direction. A recording medium in the form of a sheet 52 is fed from a sheet feed section, not shown, to the belt 46. The toner image is, therefore, transferred from the belt 46 to the sheet 52. Specifically, a pressure roller 54 presses the sheet 52 against the belt 46. A heater 56 contacts the pressure roller 54 with the intermediary of the sheet 52. As the pressure roller 54 and heater 56 nip the sheet 52 therebetween, the heater 56 instantaneously heats the toner image on the sheet 46. As a result, the toner image is transferred from the belt 46 to the sheet 52 and fixed on the sheet 52 at the same time. A cleaner 58 removes the toner remaining on the belt 46 after the transfer of the toner image to the sheet 52. A light source 60 scans the uniformly charged surface of the drum 34 with a light beam representative of image data so as to electrostatically form a latent image thereon. The light source 60 may be implemented as a laser, light emitting diode (LED) or liquid crystal by way of example.

Figure 3A:
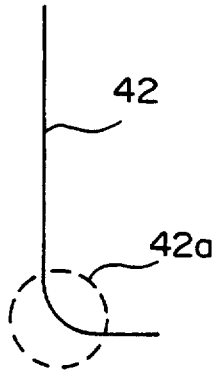
FIGS. 3A, 3B, 3C, and 3D are sections showing specific configurations of a blade included in the embodiment.
Figure 3B:
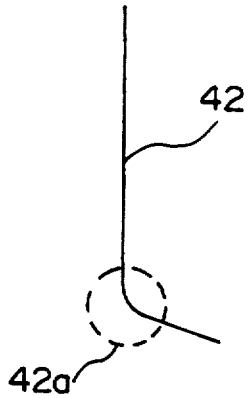
Figure 3C:
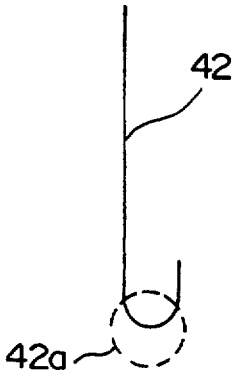
Figure 3D:
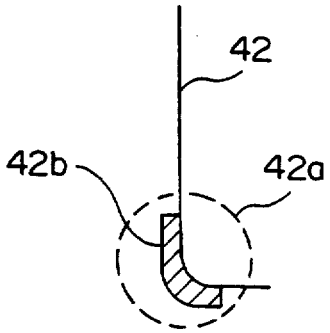

The blade 42 is constituted by a spring member made of stainless steel, phosphor bronze, nickel silver or similar metal. FIGS. 3A–3C each shows a specific section of the blade 42. As shown, the free end of the blade 42 is bent to form a generally L- or J-shaped bent portion **42*a* whose radius of curvature substantially corresponds to the thickness of the blade 42. As shown in FIG. 3D, the bent portion 42*a* is provided with a charge control material 42*b*. This material 42*b* may be comprised of a paint capable of controlling the charge characteristic, a thin film of metal formed by plating, or silicone rubber, urethane rubber or similar elastic material applied or adhered to the bent portion 42*a***.

Figure 4:
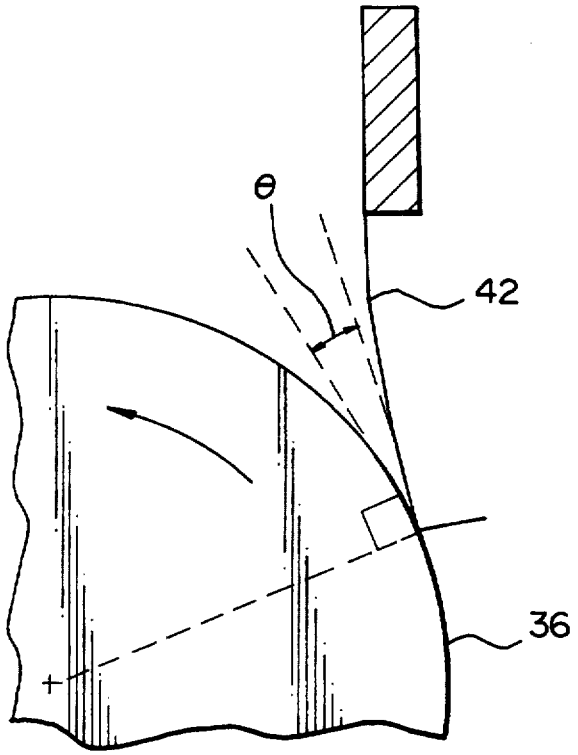
FIG. 4 is a view showing the blade in an operative position.

How the blade 42 is affixed to the developing device 30 will be described with reference to FIG. 4. As shown, the blade 42 generally extends in a direction opposite to the direction of rotation of the toner carrier 36 and is bent by about 1 millimeter to 10 millimeters in abutment against the toner carrier 36. The bent portion **42*a* contacts the toner carrier 36 and is inclined by an angle $\theta$ of less than 45 degrees relative to a line tangential to the toner carrier 36, as measured at the point where the blade 42 and toner carrier 36 contact. In this condition, the blade 42 presses the toner carrier 36 to regulate the toner T on the toner carrier 36**. The contact angle $\theta$ should preferably range from 10 degrees to 30 degrees.

On the other hand, the toner carrier 36 is implemented as a flexible member fabricated by, for example, treating the surface of silicone rubber, urethane rubber, nitrilebutylene rubber, natural rubber or sponge. The toner carrier 36 is held in contact with the drum 34 and rotatable in a direction indicated by an arrow in the figure, i.e., counterclockwise as viewed in FIG. 2. The toner supply roller 38 is made of conductive sponge, aluminum or similar material.

Figure 5:
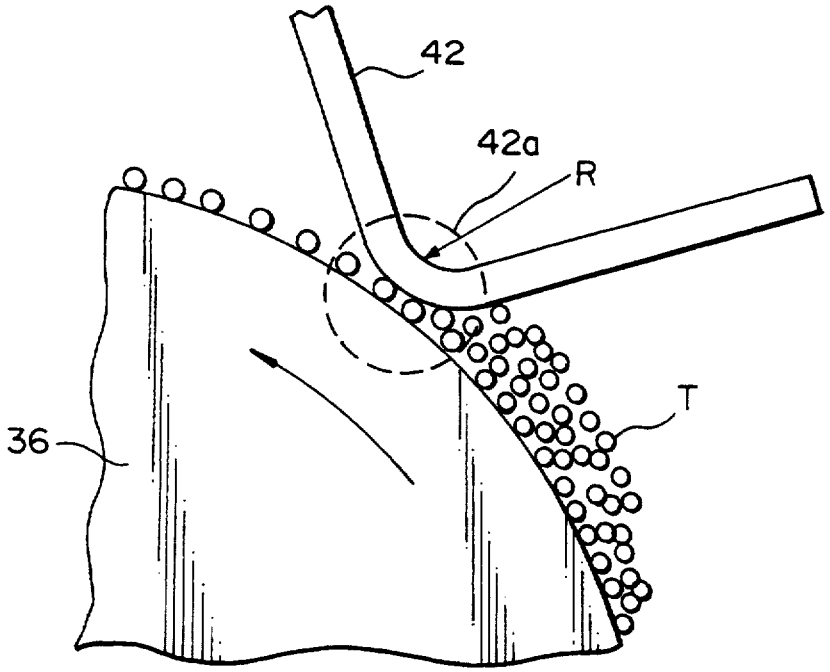
FIG. 5 is a fragmentary enlarged view showing how the blade regulates a toner.

The toner T stored in the casinc, 32 is conveyed to the toner supply roller 38 by the agitator 40 and then to the toner carrier 36. As shown in FIG. 5, the toner T deposited on the toner carrier 36 is leveled by the blade 42 to form a uniform thin layer, i.e., substantially a single layer. At the same time, the toner T is charged by friction. When the toner T in the charged thin layer is transported by the toner carrier 36 to a position where it faces the drum 34, it is deposited on a latent image formed on the drum 34. As a result, the latent image is converted to a corresponding toner image.

Experiments were conducted by use of the toner carrier 36 made of silicone rubber having a hardness of 40 degrees according to the JIS (Japanese Industrial Standard) scale, and the blade 42 implemented as a 0.1 millimeter thick spring member of stainless steel. The free end of the blade 42 was bent in the form of a letter L to form the bent portion **42*a*. The bent portion 42*a* was pressed against the toner carrier 36** at the angle $\theta$ of 18.9 degrees while being bent by 2.4 millimeters. In this condition, the toner successfully formed one or less layer when subjected to a pressure as low as 5.4 gf/mm. The toner layer was measured to be in an amount of 0.53 mg/cm$^2$ and found to be sufficiently charged. The toner sparingly contaminated the background of an image formed on the photoconductive element.

Figure 6:
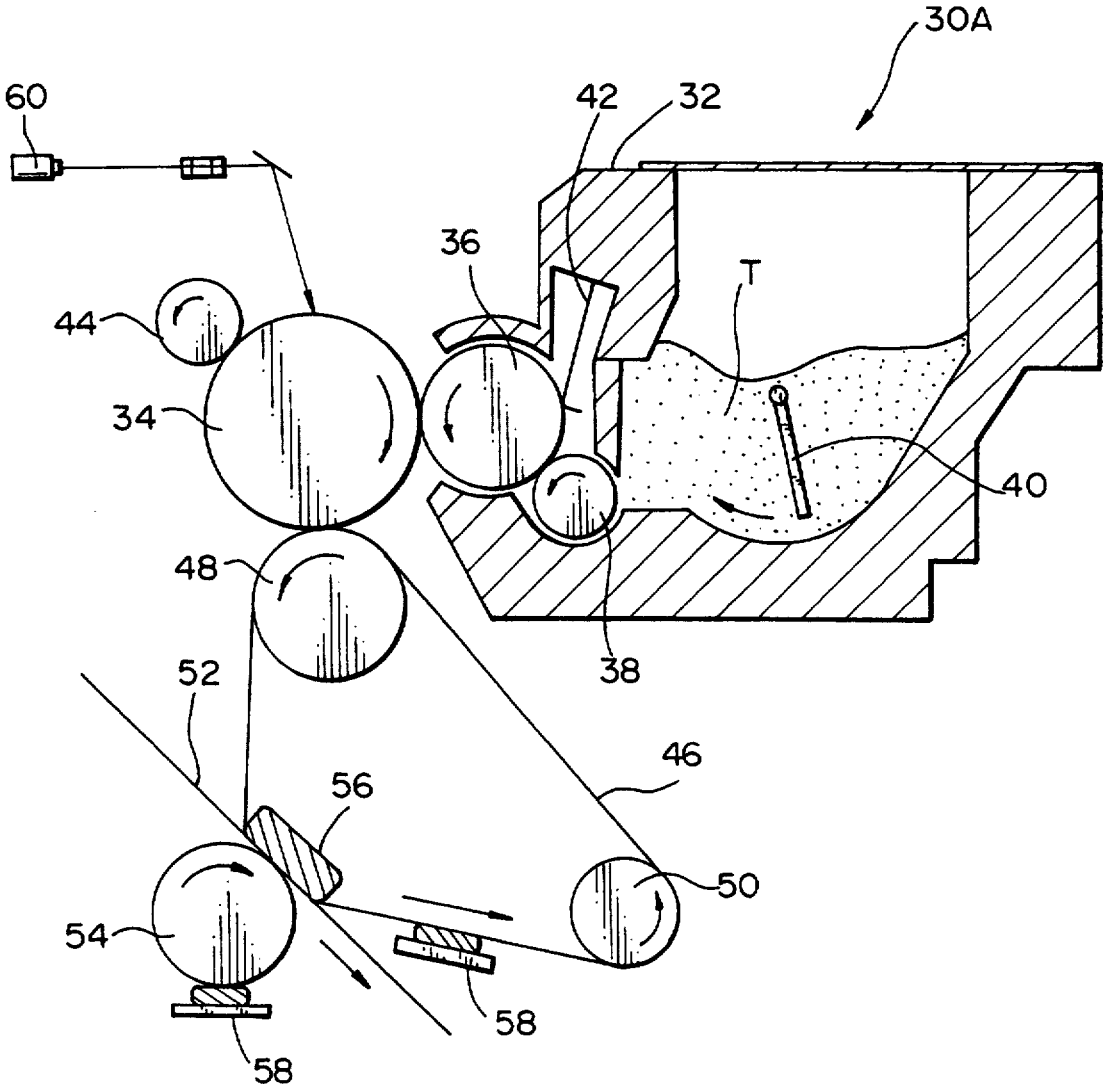
FIG. 6 is a section showing an alternative embodiment of the present invention.

FIG. 6 shows an image forming apparatus implemented with an alternative embodiment of the present invention. A s shown, the developing device 30A is essentially similar to the developing device 30 except for the general arrangement. Specifically, the device 30 also includes the toner carrier 36, blade 42 and so forth. Hence, the construction and operation of the device 30A will not be described specifically to avoid redundancy.

In summary, it will be seen that the present invention provides a developing device in which a toner regulating blade presses a toner carrier with a bent portion thereof and extends in a direction generally opposite to an intended direction of rotation of the toner carrier. Hence, the regulation over the toner can be effected not only by a pressure exerted only in a small area but also by scraping, setting up a thin toner layer at a low pressure. This is successful in charging the toner uniformly and stably and, therefore, in protecting the background of an image from contamination.

It has been customary to use a toner carrier made of metal or similar rigid material, as stated earlier. Such a toner carrier regulates the toner excessively and limits the number of toner layers to less than one or practically to zero. Such a toner layer is too thin to insure a sufficient image density. With the present invention, it is possible to prevent the image density from being lowered since the toner carrier is made of silicone rubber, urethane rubber or similar elastic material while the blade is implemented as a spring member made of metal.

Since the belt shown in FIGS. 2 and 6 has a particular resistance optimal for image transfer, a toner image can be transferred from the drum to the belt with a substantially 100% efficiency.

Various modifications will become possible for those skilled in the art after receiving the teachings of the present disclosure without departing from the scope thereof.

What is claimed is:

1. A developing device incorporated in an image forming apparatus for developing a latent image representative of image data and electronically formed on an image carrier by a toner to produce a corresponding toner image, said developing device comprising:

a toner carrier made of an elastic material for supplying the toner to the image carrier, said elastic material constituting said toner carrier comprising one of silicone rubber, urethane rubber, nitrilebutylene rubber, and natural rubber;

a toner layer regulating member constituted by a spring member made of metal for regulating a thickness of the toner deposited in a layer on said toner carrier, wherein said spring member constituting said toner layer regulating member comprises one of stainless steel, nickel silver, phosphor bronze, and beryllium copper; and wherein said spring member has a bent portion and is pressed against said toner carrier at an angle of from 5 to 30 degrees such that said bent portion contacts said toner carrier, an outside radius of the bent portion being 0.1 to 0.8 millimeter.

2. A developing device as claimed in claim 1, wherein said spring member comprises a blade, said blade extending in a direction generally opposite to an intended direction of rotation of said toner carrier.

3. A developing device incorporated in an image forming apparatus for developing a latent image representative of image data and electronically formed on an image carrier by a toner to produce a corresponding toner image, said developing device comprising:

a toner carrier made of an elastic material for supplying the toner to the image carrier;

a toner layer regulating member constituted by a spring member made of metal for regulating a thickness of the toner deposited in a layer on said toner carrier;

wherein said toner layer regulating member comprises a blade, said blade extending in a direction generally opposite to an intended direction of rotation of said toner carrier; and wherein said blade has a bent portion and is pressed against said toner carrier at an angle of from 5 to 30 degrees such that said bent portion contacts said toner carrier, an outside radius of the bent portion being 0.1 to 0.8 millimeter.

* * * * *

UNITED STATES PATENT AND TRADEMARK OFFICE

CERTIFICATE OF CORRECTION

PATENT NO. : 5,373,353
DATED : December 13, 1994
INVENTOR(S) : Hisashi FUKASAWA

It is certified that error(s) appears in the above-identified patent and that said Letters Patent is hereby corrected as shown below:

Col. 3, line 67, delete "casinc" and insert --casing--.

Col. 4, line 27, delete "A s" and insert --As--.

Signed and Sealed this

Sixteenth Day of May, 1995

*Attest:*

Bruce Lehman

BRUCE LEHMAN

*Attesting Officer*

*Commissioner of Patents and Trademarks*